US007363231B2

(12) United States Patent
Kikuiri et al.

(10) Patent No.: US 7,363,231 B2
(45) Date of Patent: Apr. 22, 2008

(54) CODING DEVICE, DECODING DEVICE, AND METHODS THEREOF

(75) Inventors: Kei Kikuiri, Yokosuka (JP); Nobuhiko Naka, Yokohama (JP); Tomoyuki Ohya, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 961 days.

(21) Appl. No.: 10/646,752

(22) Filed: Aug. 25, 2003

(65) Prior Publication Data

US 2004/0098267 A1 May 20, 2004

(30) Foreign Application Priority Data

Aug. 23, 2002 (JP) ..... 2002-244021

(51) Int. Cl.
*G10L 19/00* (2006.01)
*G10L 19/02* (2006.01)

(52) U.S. Cl. ..... 704/501; 704/229

(58) Field of Classification Search ..... 704/501
See application file for complete search history.

(56) References Cited

U.S. PATENT DOCUMENTS 5,166,686 A * 11/1992 Sugiyama ..... 341/155
5,224,167 A * 6/1993 Taniguchi et al. ..... 704/219
6,233,550 B1 * 5/2001 Gersho et al. ..... 704/208
6,263,312 B1 * 7/2001 Kolesnik et al. ..... 704/500
6,496,794 B1 * 12/2002 Kleider et al. ..... 704/201

FOREIGN PATENT DOCUMENTS

JP 9-70041 3/1997

OTHER PUBLICATIONS

Noboru Harada, et al., "5-KHZ-Bandwidth Speech Coder at 4-8Kbit/S", Speech Coding Proceedings, XP-010345531, Jun. 20, 1999, pp. 13-15.

Edward Glazebrook, et al., "Low Data Rate Adaptive Transform Coding For Parametric Representation of Speech Signals", International Symposium on Signal Processing and its Applications, vol. 2, XP-010241107, Aug. 25, 1996, pp. 768-771.

W. Bastiaan Kleijn, et al., "A 5.85 kb/s CELP Algorithm for Cellular Applications", Statistical Signal and Array Processing, vol. 4, XP-010110525, Apr. 27, 1993, pp. 596-599.

Kei Kikuiri, et al., "Super-Frame Based Source Controlled Variable Rate Coding Using Approximated Trellis Diagram", IEEE International Conference on Acoustics, Speech and Signal Processing, vol. 1 of 6, XP-010640912, Apr. 6, 2003, pp. 185-188.

* cited by examiner

*Primary Examiner*—David Hudspeth
*Assistant Examiner*—Samuel G Neway
(74) *Attorney, Agent, or Firm*—Oblon, Spivak, McClelland, Maier & Neustadt, P.C.

(57) ABSTRACT

A coding device capable of improving the coding efficiency and a decoding device for decoding a code sequence generated by the coding device are provided. In the coding device, for each of the possible block combinations obtained when dividing a frame, a coding unit encodes each block in the frame block by block at different bit rates, and at the same time, the coding unit decodes the resultant code sequences related to the frame. A calculation unit calculates the error powers of the decoded signals and the input signal. A determination unit selects a code sequence that makes the average bit rate in coding the frame not higher than a specified value and the corresponding error power a minimum. This selected code sequence is output.

15 Claims, 13 Drawing Sheets

FIG.2
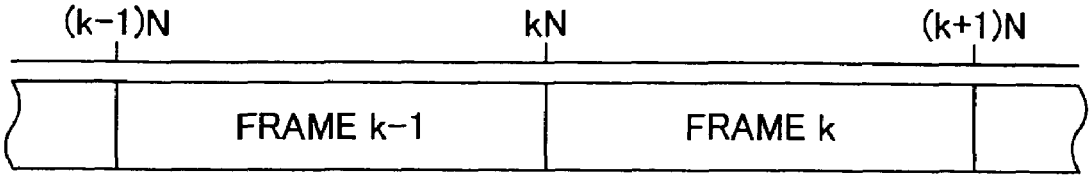
FIG.3A
FIG.3B
FIG.3C
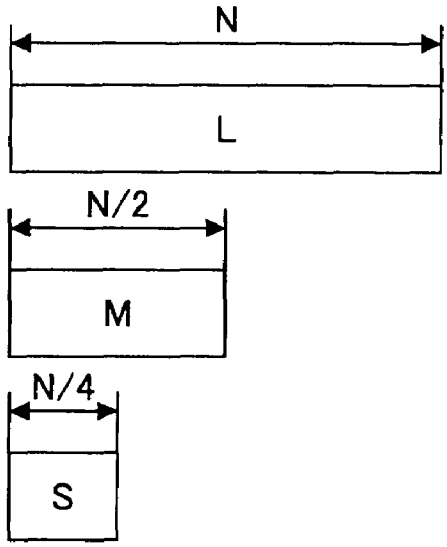

CODING DEVICE, DECODING DEVICE, AND METHODS THEREOF

BACKGROUND OF THE INVENTION

1. Field of the Invention

The present invention relates to a coding device capable of coding a signal by dividing the signal into temporally continuous frames and blocks, and a decoding device for decoding a code sequence generated by the coding device.

2. Description of the Related Art

There exist numerous kinds of methods for efficiently compressing audio signals and coding the signals, and one widely used method involves using a variable bit rate in the coding process. For example, variable bit rate coding is used in AMR (Adaptive Multi-Rate) coding, which is a standard coding scheme in 3GPP (third Generation Partnership Project), a project aiming at standardization of third generation technologies related to cellular phones. In addition, variable bit rate coding is used in AMR-WB (Adaptive Multi-Rate Wide Band) coding, which is also a standard coding scheme in 3GPP for coding wideband speech signals established as G.722.2 by ITU-T, the Telecommunication Standardization Sector for standardization of technologies in telecommunication in the ITU (International Telecommunication Union). Furthermore, variable bit rate coding is used in EVRC (Enhanced Variable Rate Code), a standard of EIA (Electronic Industries Alliance) and TIA (Telecommunication Industries Alliance).

In these coding schemes, the coding bit rate is varied block by block according to the required communication quality and the condition of the communications network. A block is a division of the input data, and has a predetermined length.

When it is necessary to code a frame having a predetermined length at a bit rate not higher than a specified bit rate, an encoder working at the specified bit rate is used. Alternatively, an encoder capable of working at variable bit rates may also be used at the specified bit rate or lower.

However, if taking into consideration human perception characteristics, it is known that among the data of one frame, some data are important for perception but some are unimportant. Therefore, compared with coding all of the data in a frame at the specified bit rate, it is advantageous to make the encoder work at higher bit rates to code the important data to ensure quality of the data, and at lower bit rates to code the unimportant data without caring about the data quality too much, while ensuring the average bit rate over the frame is not higher than the specified bit rate. In this way, data quality is improvable when taking into consideration human perception characteristics.

For example, Japanese Patent Application Laid Open, No. 9-70041 discloses a coding device capable of coding at variable bit rates, in which the bit rate is specified in each specified time interval of the input data, in other words, the bit rate is specified in each block having a predetermined length, while ensuring that the input data having a predetermined length are coded at an average bit rate not higher than a specified bit rate.

In the meantime, in MP3 (MPEG-1 Layer 3) or MPEG-2 AAC (Moving Picture Coding Expert Group 2 Advanced Audio Coding), which are international standard coding schemes in ISO/IEC and widely used in coding audio signals, the bit rate can be more adaptively varied block by block.

In addition, in time-frequency transformation coding used in coding audio signals, by making the block length variable, coding in units of blocks having variable lengths becomes possible. In the time-frequency transformation coding, when frequency characteristics of the input signal vary slowly, the block length is set long and coding is performed after transformation in the frequency domain. When frequency characteristics of the input signal change quickly, the block length is set short and coding is performed after transformation in the frequency domain. By doing this, data distortion can be suppressed, and the coding efficiency can be improved.

Although being capable of variable bit rate coding, the coding device disclosed in Japanese Patent Application Laid Open, No. 9-70041, is a device for coding digital image data, that is, the device performs coding of image data in a temporally discrete manner, while setting a variable bit rate for each unit time period.

On the other hand, in coding audio data, generally, sampled digital audio data in a certain time period are defined as a block of a predetermined length, and coding of the audio data is performed continuously along the time axis. Accordingly, from the view of improving the coding efficiency and the coding quality, the coding device disclosed in Japanese Patent Application Laid Open, No. 9-70041 cannot be applied to coding of digital signals continuously and dynamically distributed in time, for example, the audio signals.

SUMMARY OF THE INVENTION

Accordingly, it is a general object of the present invention to solve one or more problems of the related art.

A more specific object of the present invention is to provide a coding device capable of improving coding efficiency and a decoding device for decoding a code sequence generated by the coding device.

According to a first aspect of the present invention, there is provided a coding device for coding an input signal, said coding device dividing the input signal into temporally continuous frames each including a predetermined number of discrete temporal samples, the coding device comprising: a dividing unit configured to divide each of the frames into one or more blocks, said dividing unit dividing each of the frames using a plurality of block combinations; a coding unit configured to code each of the blocks at a plurality of bit rates and generate a plurality of block code sequences; and a determination unit configured to select a frame code sequence corresponding to one of the block combinations so that the selected frame code sequence has optimum quality and that an average bit rate for coding the corresponding block combination is not higher than a predetermined bit rate, said determination unit selecting the frame code sequence by determining the block lengths of the respective blocks in the corresponding block combination and determining the bit rates for coding the respective blocks in the corresponding block combination.

Preferably, the coding device further comprises a coding quality evaluation unit configured to determine data of quality of each of frame code sequences corresponding to the respective block combinations and an output unit configured to output the selected frame code sequence.

Preferably, the determination unit determines the block lengths and the bit rates using the Viterbi algorithm.

Preferably, the coding quality evaluation unit calculates a sum of data of quality of the block code sequence corresponding to one of the blocks to be coded and the data of quality of the block code sequences corresponding to blocks prior to the one of the blocks to be coded, and the determination unit uses the sum of the data of quality in determination of the block lengths and the bit rates.

Preferably, the data of quality includes an electric power of a difference between a signal obtained by decoding one of the frame code sequences and a corresponding portion in the input signal, and the determined block lengths and the bit rates make the electric power of the difference substantially a minimum. Alternatively, the data of quality includes a signal-to-noise-ratio of a signal obtained by decoding one of the frame code sequences, and the determined block lengths and the bit rates make the signal-to-noise-ratio substantially a maximum.

More preferably, a weighting factor determined by human perceiving characteristics is applied to the data of quality.

Preferably, the determination unit determines the block lengths and the bit rates using the Viterbi algorithm.

Preferably, the output unit appends data of the block lengths and the bit rates to the selected frame code sequence. The output unit may append the data of the block lengths and the bit rates to the corresponding block code sequences in the selected frame code sequence, respectively.

According to a second aspect of the present invention, there is provided a decoding device for decoding an input code sequence obtained by coding an input signal, said input signal being divided into temporally continuous frames each including a predetermined number of discrete temporal samples, and each of the frames being divided into one or more blocks for coding, the decoding device comprising: an information extracting unit configured to extract data of block lengths of the respective blocks, and data of bit rates for coding the respective blocks, and a decoding unit configured to decode the input code sequence according to the extracted data of the block lengths and the data of the bit rates.

Preferably, data of the block lengths and the data of the bit rates are appended to the input code sequence. More preferably, the input code sequence includes one or more block code sequences obtained by coding the respective blocks, and the data of the block lengths and the data of the bit rates are appended to the block code sequences, respectively.

According to a third aspect of the present invention, there is provided a coding method for coding an input signal, wherein the input signal is divided into temporally continuous frames each including a predetermined number of discrete temporal samples, the coding method comprising: a first step of dividing each of the frames into one or more blocks, said each of the frames being divided by using a plurality of block combinations; a second step of coding each of the blocks at a plurality of bit rates and generating a plurality of block code sequences; and a third step of selecting a frame code sequence corresponding to one of the block combinations so that the selected frame code sequence has optimum quality and that an average bit rate for coding the corresponding block combination is not higher than a predetermined bit rate, said selected frame code sequence being selected by determining the block lengths of the respective blocks in the corresponding block combination and the bit rates for coding the respective blocks in the corresponding block combination.

Preferably, the coding method further comprising: a step, before the third step, of determining data of quality of each of frame code sequences corresponding to the respective block combinations; and a step, after the third step, of outputting the selected frame code sequence.

According to a fourth aspect of the present invention, there is provided a decoding method for decoding an input code sequence obtained by coding an input signal, said input signal being divided into temporally continuous frames each including a predetermined number of discrete temporal samples, and each of the frames being divided into one or more blocks for coding, the decoding method comprising the steps of extracting data of block lengths of the respective blocks and data of bit rates for coding the respective blocks, and decoding the input code sequence according to the extracted data of the block lengths and the data of the bit rates.

According to the present invention, the coding device makes both the lengths of blocks and the bit rates in coding the blocks variable. Therefore, it is possible to perform coding according to the combination of the lengths of blocks and the bit rates. Further, among the frame code sequences generated in coding all kinds of block combinations, a frame code sequence can be selected, which has the optimum quality and ensures that the bit rate in coding the frame is not higher than a specified value. As a result, it is possible to improve the coding efficiency and the coding quality.

These and other objects, features, and advantages of the present invention will become more apparent from the following detailed description of the preferred embodiments given with reference to the accompanying drawings.

BRIEF DESCRIPTION OF THE DRAWINGS

FIG. 2 is a data diagram of frames;

FIGS. 3A through 3C are data diagrams of blocks;

DESCRIPTION OF THE PREFERRED EMBODIMENTS

Below, preferred embodiments of the present invention are explained with reference to the accompanying drawings.

First Embodiment

Figure 1:
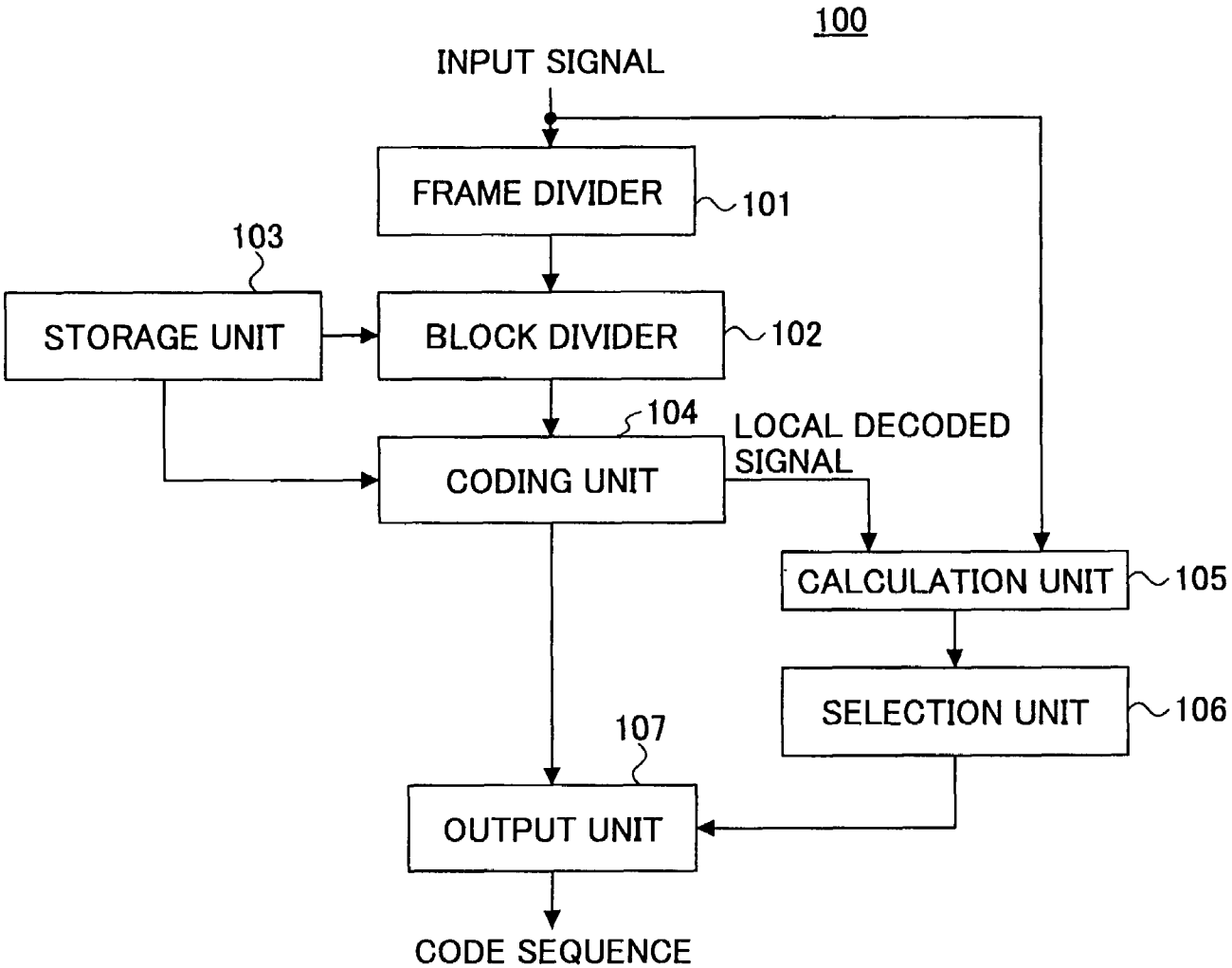
FIG. 1 is a block diagram showing an example of a configuration of a coding device according to a first embodiment of the present invention.

FIG. 1 is a block diagram showing an example of a configuration of a coding device 100 according to a first embodiment of the present invention.

The coding device 100 includes a frame divider 101, a block divider 102, a storage unit 103 for storing data of combinations of blocks and bit rates, a coding unit 104, a calculation unit 105, a selection unit 106 for selecting blocks and bit rates, and a code sequence output unit 107.

The frame divider 101 divides input signals into temporally continuous frames each having a predetermined length N, and outputs the frame data to the block divider 102.

FIG. 2 is a data diagram of an example of thus obtained frames.

FIG. 2 shows a frame k−1 in a time interval from time (k−1)N to time kN in the input signal, and a frame k in a time interval from time kN to time (k+1)N in the input signal, and each of the frame k−1 and the frame k has a length N.

Below, explanations are made of a case in which the coding device 100 performs coding of the input data with the average bit rate in coding one frame of length N not higher than a specified value, for example, 20 kbps.

The block divider 102 divides each frame of length N into blocks based on the data stored in the storage unit 103 indicating possible combinations of blocks and bit rates when dividing a frame.

FIGS. 3A through 3C are data diagrams of examples of thus obtained blocks.

FIGS. 3A through 3C show blocks having different block lengths. The block in FIG. 3A has a length N, that is, the same as a frame (below, this block is referred to as "L block"). The block shown in FIG. 3B has a length N/2 (referred to as "M block" below), and the block shown in FIG. 3C has a length N/4 (referred to as "S block" below).

FIGS. 4A through 4F are data diagrams showing examples of possible combinations of blocks when dividing a frame into blocks. Here, as an example, it is assumed that the three kinds of blocks are generated, which have lengths N, N/2, and N/4, respectively, as shown in FIG. 3, and combinations of these three kinds of blocks are considered.

Figure 4A:
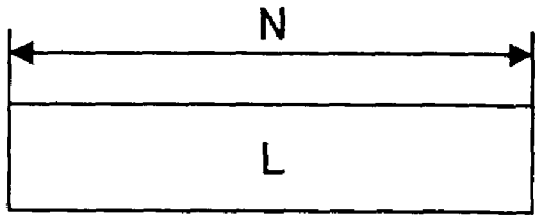
FIGS. 4A through 4F are data diagrams showing examples of possible combinations of blocks when dividing a frame into blocks.
Figure 4B:
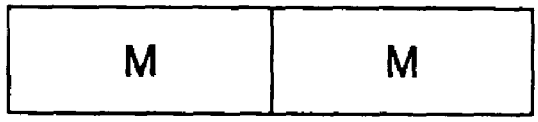
Figure 4C:
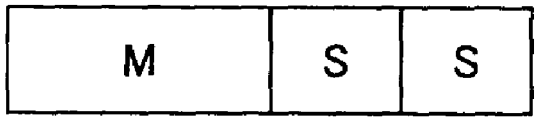
Figure 4D:
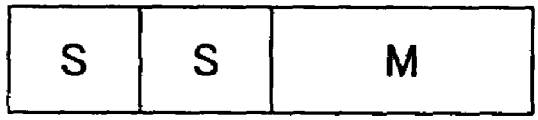
Figure 4E:
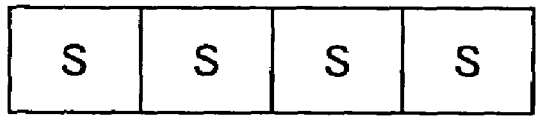
Figure 4F:
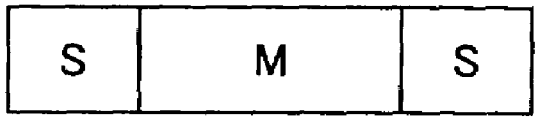

In FIG. 4A, a frame of length N includes one L block; in FIG. 4B, the frame includes two M blocks; in FIG. 4C, the frame includes one block M and two S blocks; in FIG. 4D, the frame includes two S blocks and one M block; in FIG. 4E, the frame includes four S blocks; and in FIG. 4F, the frame includes one S block, one M block and one S block.

The block divider 102 outputs all the combinations of the blocks of one frame to the coding unit 104.

For each of the possible block combinations obtained in dividing a frame, the coding unit 104 performs coding for each block at different bit rates. The data of the bit rates are stored in the storage unit 103; for example, they are 16 kbps, 20 kbps, and 24 kbps.

If a coding method is adopted in which the present coding result does not depend on the previous coding results, it is preferable that the coding unit 104 perform coding for each block at different bit rates in advance, and provide the resultant code sequences in conjunction with the block combinations of one frame, respectively.

For example, the coding result of the first M block in the combination in FIG. 4B is the same as that of the M block in the combination in FIG. 4C, and their decoding results are also the same. Therefore, the coding unit 104 performs coding of the M block at different bit rates in advance, and provides the resultant code sequences to M blocks allocated in combinations shown in FIG. 4B and FIG. 4C, respectively.

The coding unit 104 outputs the code sequences generated in coding different block combinations related to one frame to the code sequence output unit 107. Below, a code sequence generated in coding a block combination related to a frame is referred to as a frame code sequence. In addition, the coding unit 104 decodes the frame code sequences and outputs the signals (local decoded signal) generated in the decoding process to the calculation unit 105.

The calculation unit 105 calculates the electric power level of the difference between the local decoded signal and the portion in the input signal corresponding to the local decoded signal. This electric power level of difference is the power of the error signal, and is referred to as "error power" below. In this calculation, it is preferable that the calculation unit 105 weight the obtained error power according to the human perception characteristics. For example, if the amplitude of a certain frequency component of an audio signal is large, the quantum noise in the neighboring frequency region is hard to perceive. For this reason, the calculation unit 105 applies a small weighting factor to the frequency components in the neighboring frequency region. The calculation unit 105 outputs the calculated error power to the selection unit 106.

The selection unit 106 selects a frame code sequence from the frame code sequences generated in coding all the block combinations related to one frame so that the selected frame code sequence ensures that the average bit rate in coding the frame is not higher than a specified value (for example, 20 kbps), and the corresponding error power is the minimum.

Further, the selection unit 106 selects and outputs information on lengths of the blocks in the frame corresponding to the selected frame code sequence, and information of bit rates in coding the blocks to the code sequence output unit 107.

The code sequence output unit 107 selects and outputs a frame code sequence from the frame code sequences output from the coding unit 104. The selected frame code sequence corresponds to the length information of the blocks and the bit rate information in coding the blocks output from the selection unit 106. Further, when outputting the selected frame code sequence, the code sequence output unit 107 appends the information of lengths of the blocks and the information of bit rates in coding the blocks to the selected frame code sequence.

Figure 5:
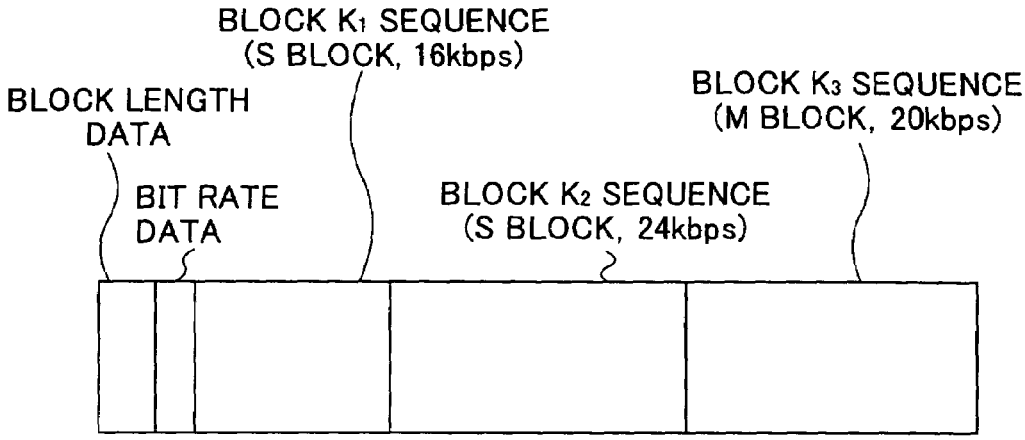
FIG. 5 is a data diagram showing an example of a code sequence obtained by coding a frame.
Figure 6:
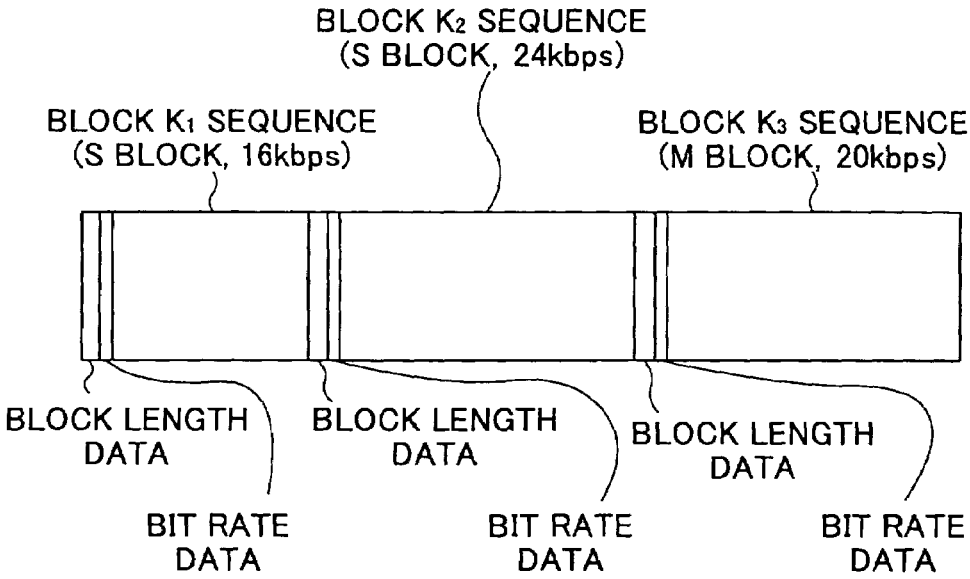
FIG. 6 is a data diagram showing another example of a code sequence obtained by coding a frame.

FIG. 5 is a data diagram showing an example of a frame code sequence output by the code sequence output unit 107, and FIG. 6 shows another example.

In FIG. 5 and FIG. 6, a frame is divided into three blocks including an S block k1, an S block k2, and an M block k3, and the S block k1 is coded at a bit rate of 16 kbps, the S block k2 is coded at a bit rate of 24 kbps, and the M block k3 is coded at a bit rate 20 kbps. FIG. 5 and FIG. 6 show the resultant frame code sequence.

In FIG. 5, at the beginning of the frame code sequence, the information of lengths of blocks in the corresponding frame and the bit rates in coding the blocks is allocated.

In FIG. 6, at the beginning of each block code sequence (a code sequence generated by coding a block), the information of the length of the block and the bit rate in coding the block is allocated.

Figure 7:
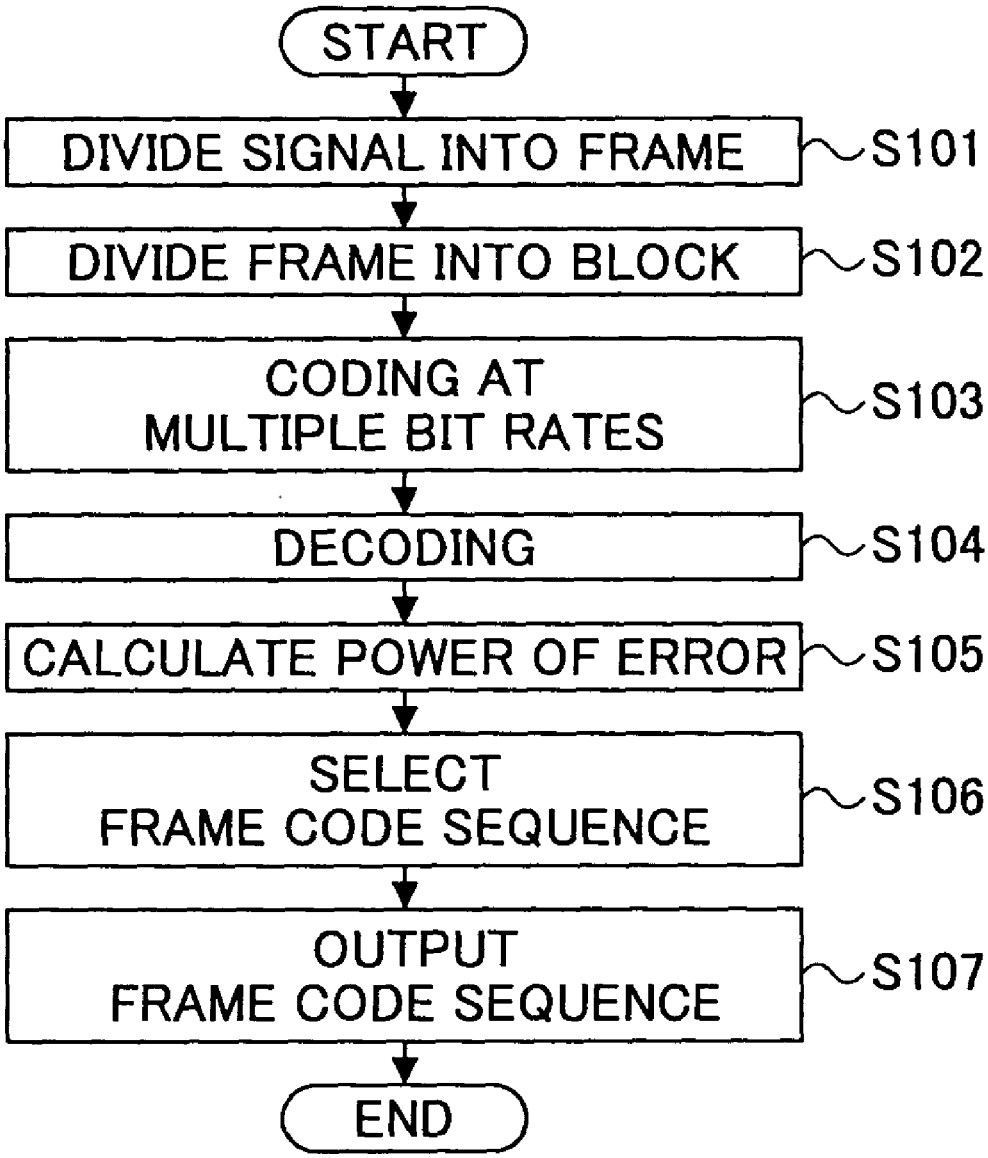
FIG. 7 is a flow chart showing the operations of the coding device according to the first embodiment.

FIG. 7 is a flow chart showing the operations of the coding device 100 according to the first embodiment.

As shown in FIG. 7, in step S101, the coding device 100 divides input signals into temporally continuous frames each having a predetermined length N.

In step S102, the coding device 100 divides each frame into blocks and generates all possible combinations of blocks.

In step S103, the coding device 100 performs coding at different bit rates for each block included in all of the block combinations obtainable when dividing one frame.

In step S104, the coding device 100 decodes the resultant frame code sequences and outputs local decoded signals.

In step S105, the coding device 100 calculates error powers of the local decoded signals and the portion in the input signal corresponding to the local decoded signals.

In step S106, the coding device 100 selects a frame code sequence from the frame code sequences generated in coding all the block combinations related to one frame so that the selected frame code sequence ensures that the average bit rate in coding the frame is not higher than a specified value, and the corresponding error power is the minimum.

In step S107, the coding device 100 appends the information of lengths of the blocks and the information of bit rates in coding the blocks to the selected frame code sequence and outputs the information and the selected frame code sequence.

Second Embodiment

Figure 8:
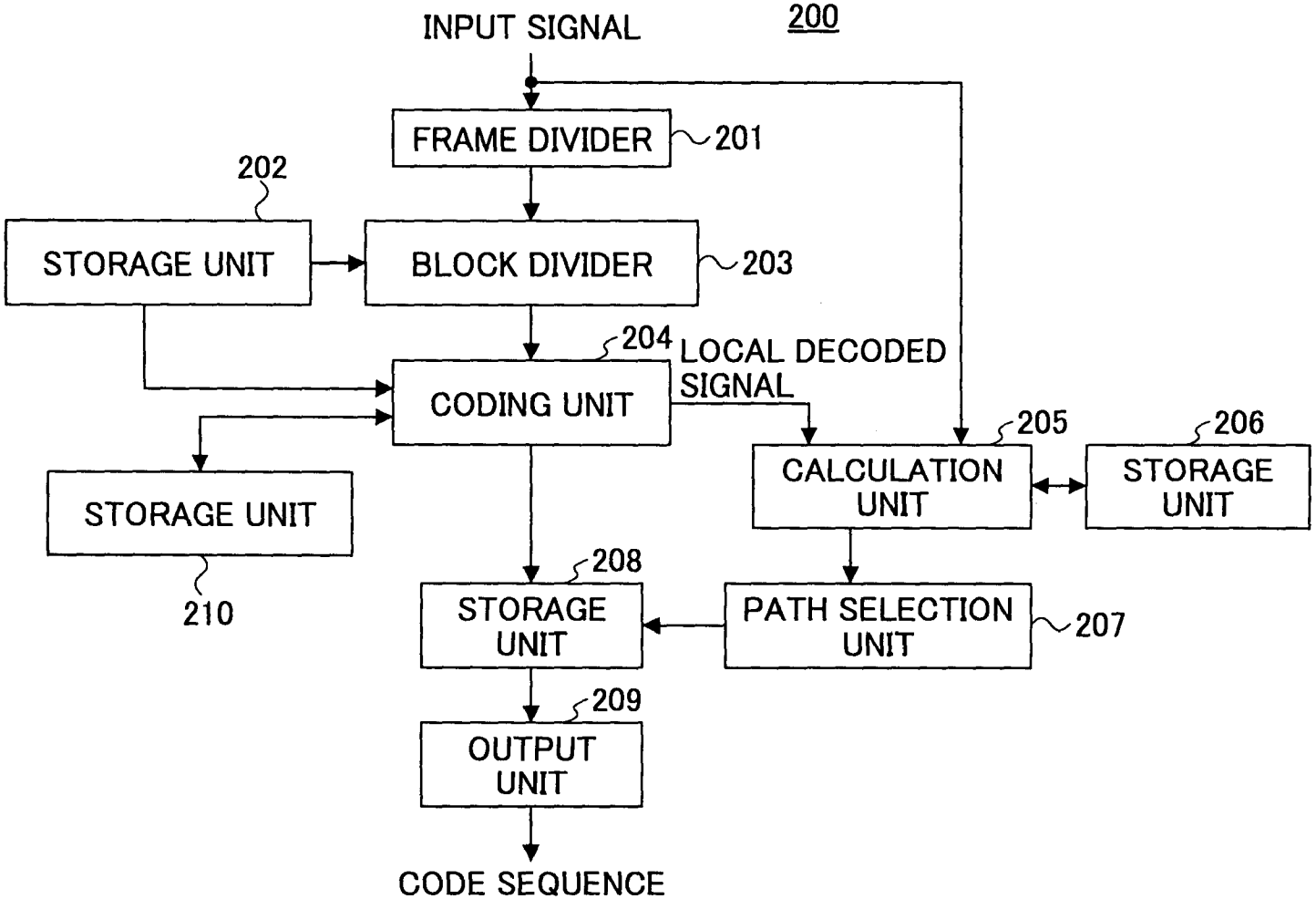
FIG. 8 is a block diagram showing an example of a configuration of a coding device according to a second embodiment of the present invention.

FIG. 8 is a block diagram showing an example of a configuration of a coding device 200 according to a second embodiment of the present invention. In this embodiment, the best coding path is selected based on a trellis diagram, and this is the so-called "Viterbi algorithm".

The coding device 200 includes a frame divider 201, a storage unit 202 for storing a trellis diagram of different combinations of blocks and bit rates, a block divider 203, a coding unit 204, a calculation unit 205, a storage unit 206 for storing data of error powers, a path selection unit 207, a storage unit 208 for storing the code sequences, a code sequence output unit 209, and an encoder state storage unit 210.

Below, explanations are made of a case in which the coding device 200 performs coding of the input data, wherein the average bit rate in coding one frame of length N is not higher than a specified value, for example, 20 kbps. In addition, the blocks used in the present embodiment are the same as those shown in FIGS. 3A through 3C, that is, the L block, M block, and S block, and the combinations of blocks shown in FIGS. 4A through 4F are used as the possible combinations of blocks when dividing one frame in the present embodiment.

The frame divider 201 divides input signals into temporally continuous frames each having a predetermined length N, and outputs the frame data to the block divider 203.

The storage unit 202 stores a trellis diagram of combinations of lengths of blocks and bit rates for the blocks.

Figure 9:
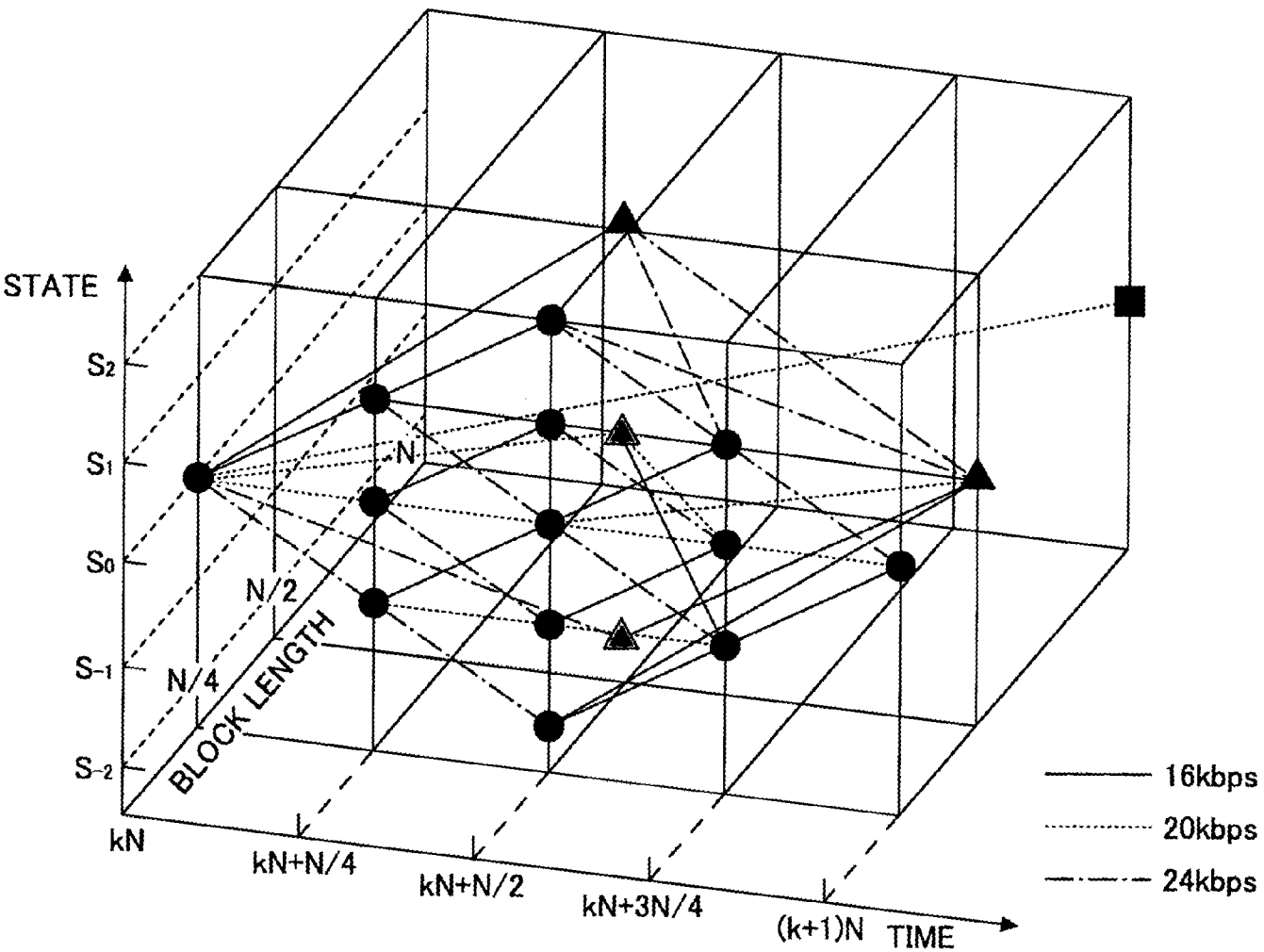
FIG. 9 is an example of a three-dimensional trellis diagram according to the second embodiment of the present invention.

FIG. 9 shows an example of a three-dimensional trellis diagram, where variation with time of lengths of blocks and bit rates in coding the blocks is illustrated.

Figure 10:
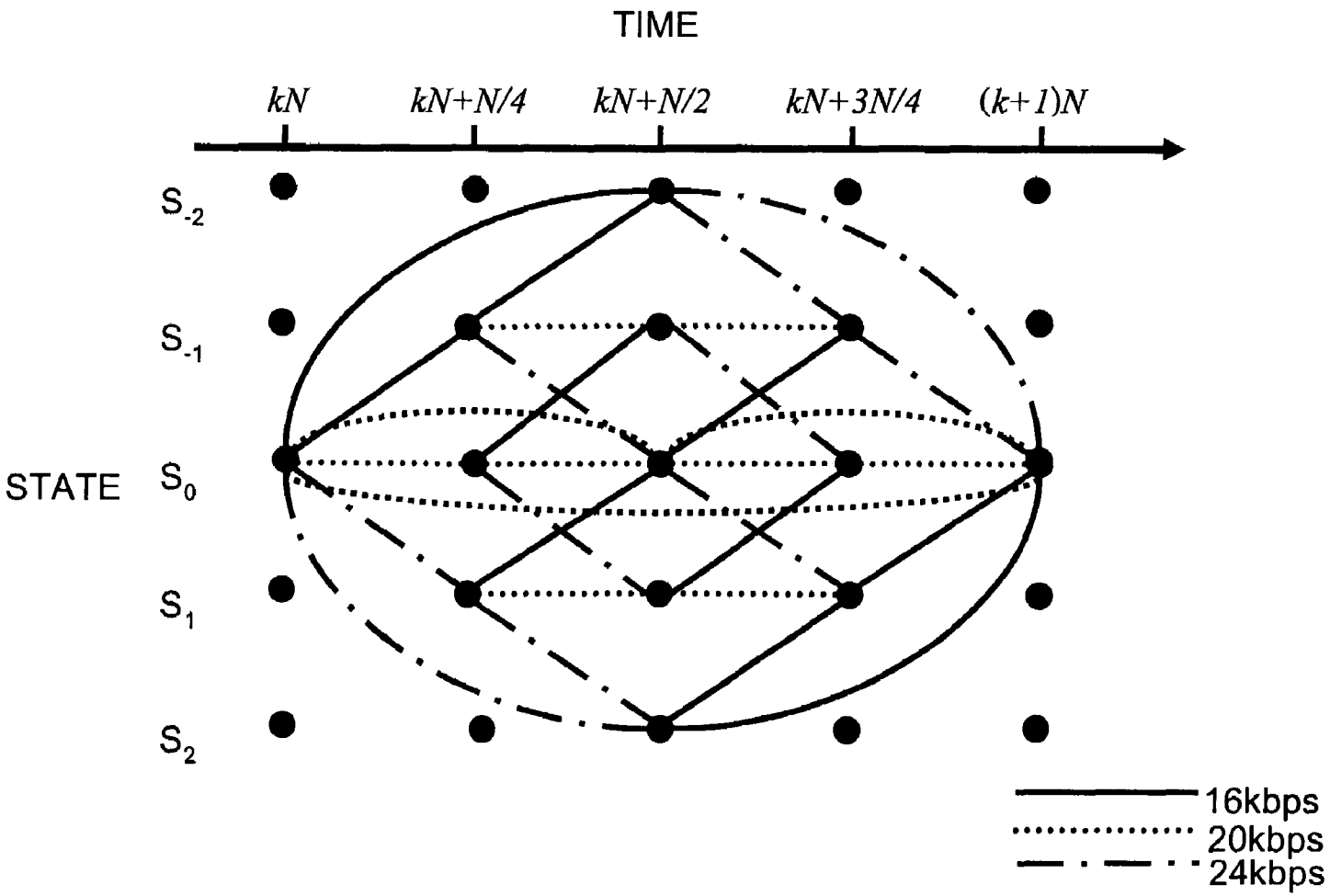
FIG. 10 is an example of a two-dimensional trellis diagram according to the second embodiment of the present invention.

FIG. 10 shows an example of a two-dimensional trellis diagram, where variation with time of bit rates is illustrated. FIG. 10 is obtained by projecting the trellis diagram in FIG. 9 in the time versus bit rate plane.

Below, for purpose of simplicity, the trellis diagram in FIG. 10 is used for description. The trellis diagram in FIG. 10 starts from time kN and a state $S_0$, and ends at time (k+1)N and the state $S_0$. In FIG. 10, "state" indicates an average bit rate at a specific time.

The block divider 203 divides each frame of length N into blocks based on the trellis diagram stored in the storage unit 202 indicating possible combinations of blocks and bit rates. For example, the block divider 203 generates an S block, in the time interval from time kN to time kN+N/4.

The coding unit 204 reads out data indicating possible combinations of blocks and bit rates corresponding to time kN+N/4 from the trellis diagram stored in the storage unit 202, obtains bit rates included in the data, and then performs coding at the bit rates.

For example, the bit rates obtained by the coding unit 204, from the trellis diagram shown in FIG. 10, may be 16 kbps, 20 kbps, and 24 kbps. Here, the initial encoder state of the starting node is set as the initial state of a not-illustrated encoder in the coding unit 204. Since the state $S_0$ at time kN is the starting node in the trellis diagram of the frame k, the encoder state after coding of the frame k−1 is set as the initial encoder state.

Further, the coding unit 204 decodes three block code sequences (that is, a code sequence generated by coding a block), and obtains local decoded signals respectively corresponding to the branches from time kN to time kN+N/4 in the two-dimensional trellis diagram shown in FIG. 10.

The calculation unit 205 calculates the error power of one of the local decoded signals corresponding to one of the branches from time kN to time kN+N/4 in the two-dimensional trellis diagram shown in FIG. 10 and the portion in the input signal corresponding to the local decoded signal.

Further, from the storage unit 206, the calculation unit 205 reads out a cumulative error power accumulated until the starting nodes of the above branches in the two-dimensional trellis diagram shown in FIG. 10. Here, the state $S_0$ at time kN is the starting node of the above branches and the cumulative error power until the state $S_0$ is zero.

Next, the calculation unit 205 adds the cumulative error power to the respective error powers of the above branches from time kN to time kN+N/4 in the two-dimensional trellis diagram shown in FIG. 10, and calculates a new cumulative error power of the paths from the starting node $S_0$ to the nodes at time kN+N/4.

The path selection unit 207 selects the best path from among all the incoming paths to each of the nodes at time kN+N/4 in the two-dimensional trellis diagram shown in FIG. 10, so that the new cumulative error power of the selected path is the minimum among the incoming paths to the node. Specifically, as shown in FIG. 10, since there is only one incoming path to each node at time kN+N/4 in the two-dimensional trellis diagram shown in FIG. 10, the path selection unit 207 selects this incoming path as the best path to each node at time kN+N/4.

The storage unit 208 stores the block code sequences respectively corresponding to the best paths to the nodes at time kN+N/4 selected by the path selection unit 207 from the block code sequences output by the coding unit 204. The storage unit 206 stores the new cumulative error powers until the nodes at time kN+N/4.

The encoder state storage unit 210 stores the encoder states after coding of the best paths to the nodes at time kN+N/4 as the initial encoder states of the nodes at time kN+N/4.

In the two-dimensional trellis diagram shown in FIG. 10, for all nodes at time kN+N/2, there are paths for coding an M block from time kN, and paths for coding an S block from time kN+N/4. Therefore, the block divider 203 divides a frame into M blocks from time kN to time kN+N/2 and S blocks from time kN+N/4 to time kN+N/2.

The coding unit 204 reads out data indicating possible combinations of blocks and bit rates corresponding to time kN+N/2 from the trellis diagram stored in the storage unit 202, obtains the bit rates included in the data, and performs coding of the above two kinds of blocks at these bit rates, and then decodes the resultant block code sequences.

For example, considering the state $S_{-2}$ at time kN+N/2 in the trellis diagram shown in FIG. 10, there are an incoming path for coding an M block from the state $S_0$ at time kN to the state $S_{-2}$ at time kN+N/2, and an incoming path for coding an S block from the state $S_{-1}$ at time kN+N/4 to the state $S_{-2}$ at time kN+N/2. Therefore, the coding unit 204 performs coding of each of the M block and S block at the obtained bit rates, for example, 16 kbps, and then, decodes the resultant block code sequences.

When coding the M block, the initial encoder state is the initial encoder state of the state S0 at time kN, and when coding the S block, the initial encoder state is the initial encoder state of the state S−1 at time kN+N/4. The coding unit 204 reads out the initial encoder state data from the encoder state storage unit 210.

Next, the same steps as described above are repeated.

That is, the calculation unit 205 calculates the error power of one of the local decoded signal corresponding to one of the branches from time kN to time kN+N/2 in the two-dimensional trellis diagram shown in FIG. 10 and the portion in the input signal corresponding to the local decoded signal. Further, the calculation unit 205 reads out from the storage unit 206 a cumulative error power until the starting nodes of the branches under consideration in the two-dimensional trellis diagram shown in FIG. 10.

Next, the calculation unit 205 adds the cumulative error powers to the error powers respectively corresponding to the branches until time kN+N/2 in the two-dimensional trellis diagram shown in FIG. 10, and calculates new cumulative error powers until nodes at time kN+N/2 in the two-dimensional trellis diagram shown in FIG. 10.

For each of the nodes at time kN+N/2, the path selection unit 207 selects the best path from all the incoming paths to the node in the two-dimensional trellis diagram shown in FIG. 10 so that the new cumulative error power of the selected path is the minimum.

The storage unit 208 stores the block code sequences corresponding to the respective best paths to the nodes at time kN+N/2 selected by the path selection unit 207 from the block code sequences output by the coding unit 204. The storage unit 206 stores the new cumulative error powers until the nodes at time kN+N/2.

The coding device 200 repeats the processing until the end of the trellis diagram in FIG. 10, and finally, the path selection unit 207 selects the best path from the starting node to the ending node in the trellis diagram in FIG. 10. Then, the storage unit 208 stores the frame code sequence corresponding to the best path.

The code sequence output unit 209 appends block length data and bit rate data for the block code sequences in the frame code sequence to the frame code sequence, which is stored in the storage unit 208, and then outputs the frame code sequence.

Concerning path selection using the three-dimensional trellis diagram in FIG. 9, the path selection is performed for each straight line related to each state in the plane of a specific time. For example, in the three-dimensional trellis diagram in FIG. 9, the aforesaid path selection for state S0 at time kN+N/2 in the two-dimensional trellis diagram in FIG. 10 is performed along the straight line of the state S0 at time kN+N/2. Therefore, the best path is selected from the incoming path to the node of the state S0 in the plane with a block length of N/4 and the incoming path to the node of the state S0 in the plane with a block length of N/2.

It is certain that path selection methods other than the above can be used. In addition, the present embodiment is applicable even when there are no limits to the possible combinations of blocks when dividing one frame.

Figure 11:
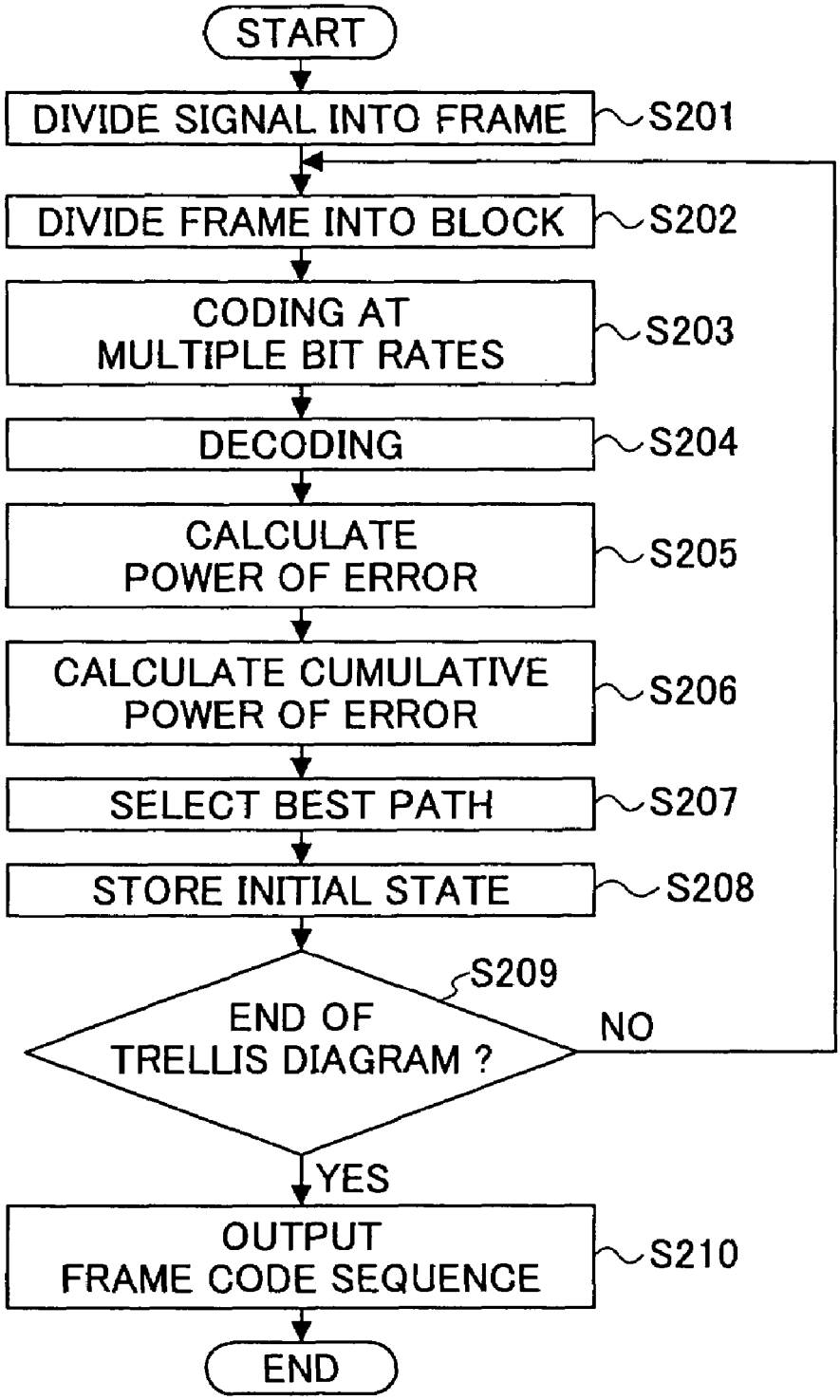
FIG. 11 is a flow chart showing the operations of the coding device according to the second embodiment.

FIG. 11 is a flow chart showing the operations of the coding device 200 according to the second embodiment.

As shown in FIG. 11, in step S201, the coding device 200 divides the input signal into temporally continuous frames each having a predetermined length N.

In step S202, the coding device 200 divides each frame into blocks based on the trellis diagram stored in the storage unit 202 indicating possible combinations of lengths of blocks and bit rates in coding the blocks.

In step S203, the coding device 200 reads out data indicating possible combinations of blocks and bit rates at a specific time from the trellis diagram stored in the storage unit 202, obtains bit rates, and then performs coding at the bit rates.

In step S204, the coding device 200 decodes the frame code sequences and outputs local decoded signals corresponding to respective branches until the specific time.

In step S205, the coding device 200 calculates the error powers of the local decoded signals corresponding to the related branches in the time interval from the specific time to the preceding time in the trellis diagram and the portion in the input signal corresponding to the local decoded signals.

In step S206, the coding device 200 adds the cumulative error powers at the preceding time to the calculated error powers, and calculates new cumulative error powers up to the nodes at the specific time.

In step S207, the coding device 200 selects best paths from all the incoming paths to the nodes at the specific time, which make the new cumulative error powers minima.

In step S208, the coding device 200 stores the block code sequences corresponding to the respective best paths and the initial encoder states of the nodes.

In step S209, the coding device 200 determines whether the best path is selected to the end of the trellis diagram. If the best path is selected to the end, the routine proceeds to step S210, otherwise, the routine goes back to step S202, and the coding device 200 repeats the step 202 and the steps subsequent.

In step S210, since the best path is selected to the end of the trellis diagram, the coding device 200 outputs the frame code sequence corresponding to the best path with block length information and coding bit rate information appended.

Third Embodiment

Figure 12:
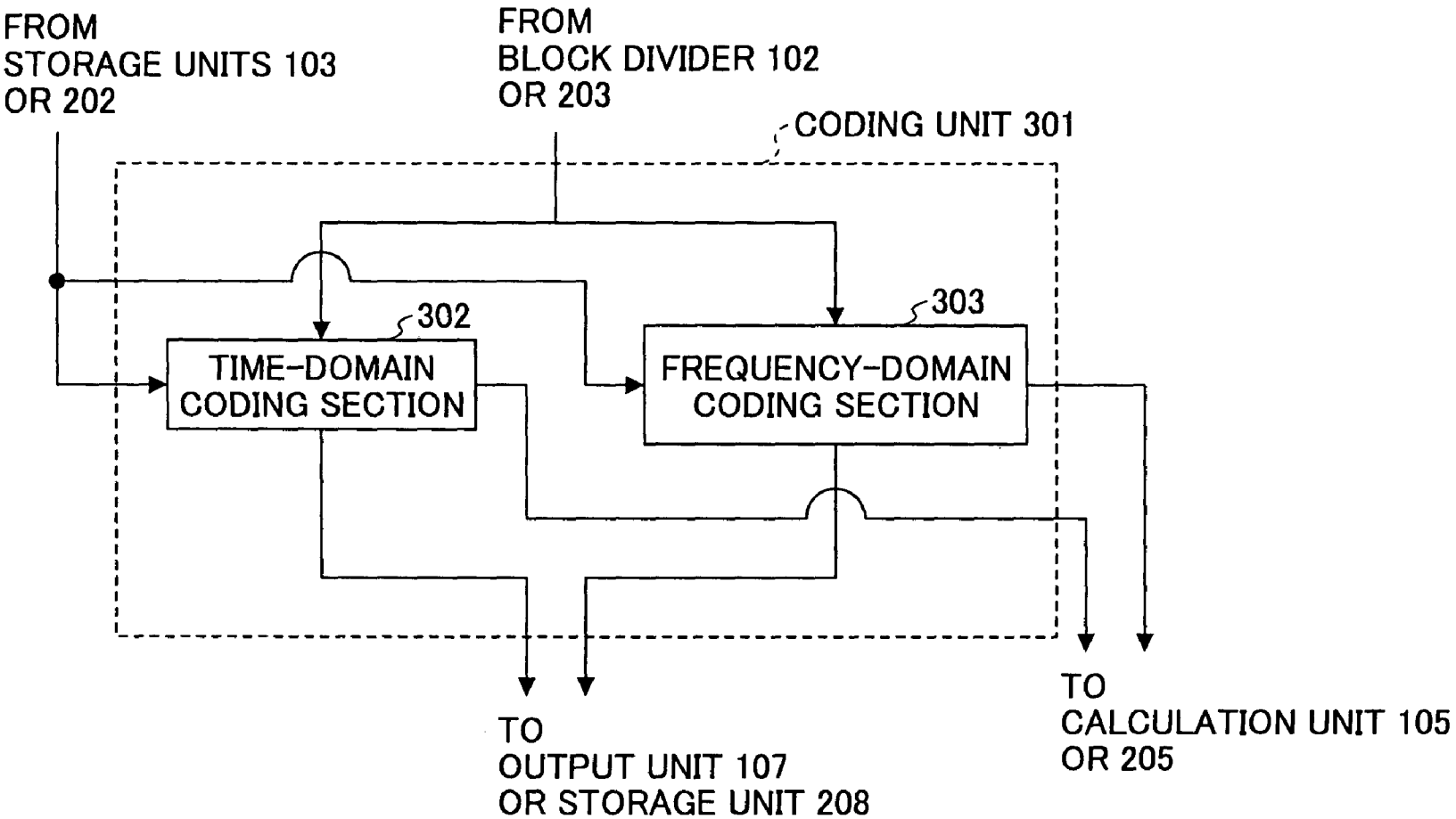
FIG. 12 is a block diagram showing an example of a configuration of a coding unit capable of variable bit rate coding according to a third embodiment of the present invention.

FIG. 12 is a block diagram showing an example of a configuration of a coding unit according to a third embodiment of the present invention.

The coding unit 301 shown in FIG. 12 may be used to replace the coding unit 104 in the coding device 100 of the first embodiment, and the coding unit 204 in the coding device 200 of the second embodiment. The coding unit 301 includes a time-domain coding section 302 and a frequency-domain coding section 303. That is, the coding unit 301 is capable of using more than one coding method (here, time-domain coding and frequency-domain coding).

By using the coding unit 301 in the coding device 100 of the first embodiment and the coding unit 204 in the coding device 200 of the second embodiment, it is possible to optimize the coding method.

Figure 13:
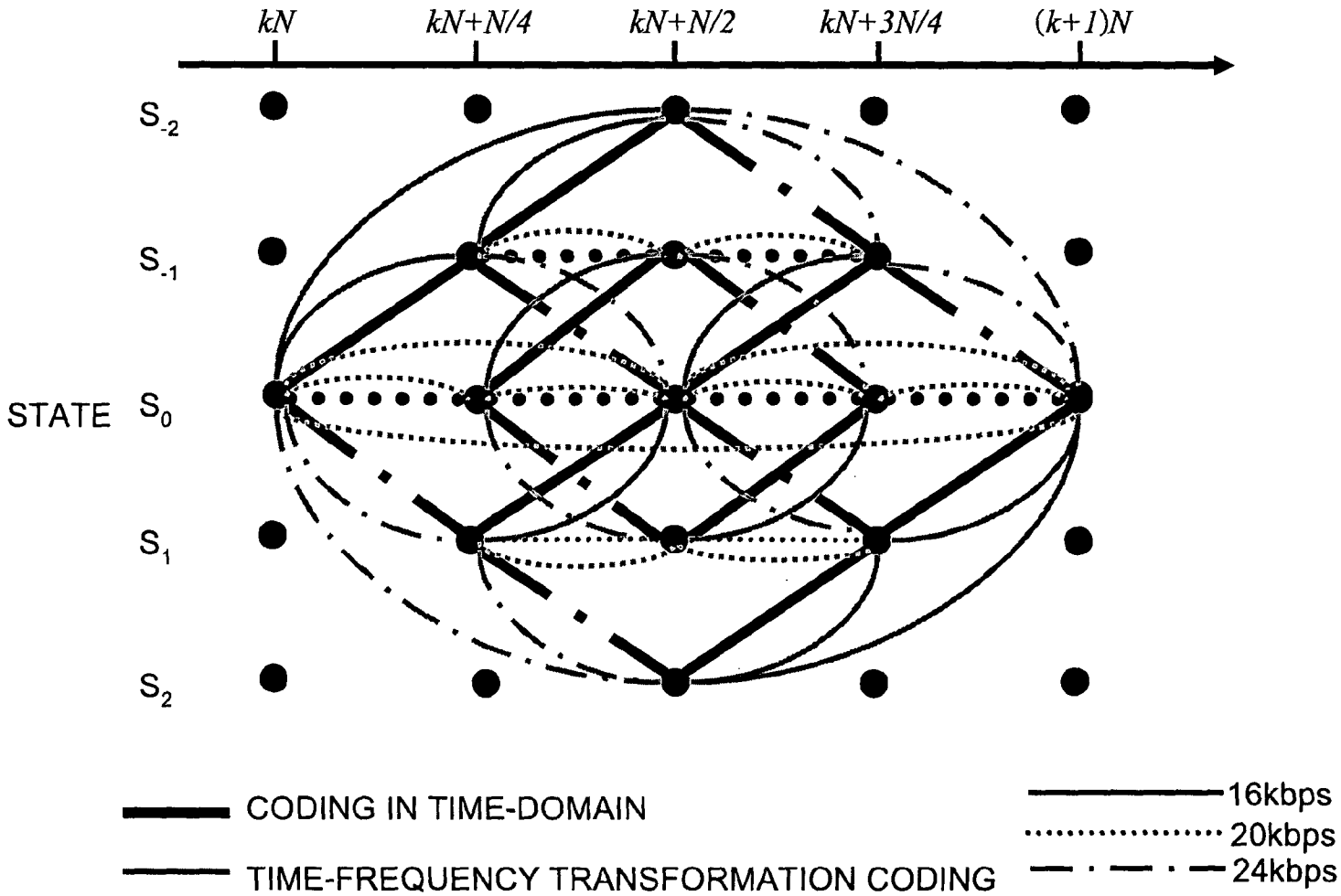
FIG. 13 is an example of a two-dimensional trellis diagram according to the third embodiment of the present invention.

FIG. 13 shows an example of a two-dimensional trellis diagram according to the third embodiment of the present invention.

When using the coding unit 301 in the coding device 200 of the second embodiment, the two-dimensional diagram in terms of time and bit rate as shown in FIG. 13 can be obtained under the following conditions, that is, the coding device 200 performs coding of the input data equal to one frame of length N at an average bit rate not higher than a specified value, for example, 20 kbps, the blocks used in the present embodiment are the same as those shown in FIGS. 3A through 3C, that is, the L block, M block, and S block, the possible combinations of blocks when dividing one frame in the present embodiment are the same as those shown in FIGS. 4A through 4F, and the time-domain coding section 302 performs coding of S blocks only.

Detailed explanation of the trellis diagram in FIG. 13 is omitted.

Fourth Embodiment

Figure 14:
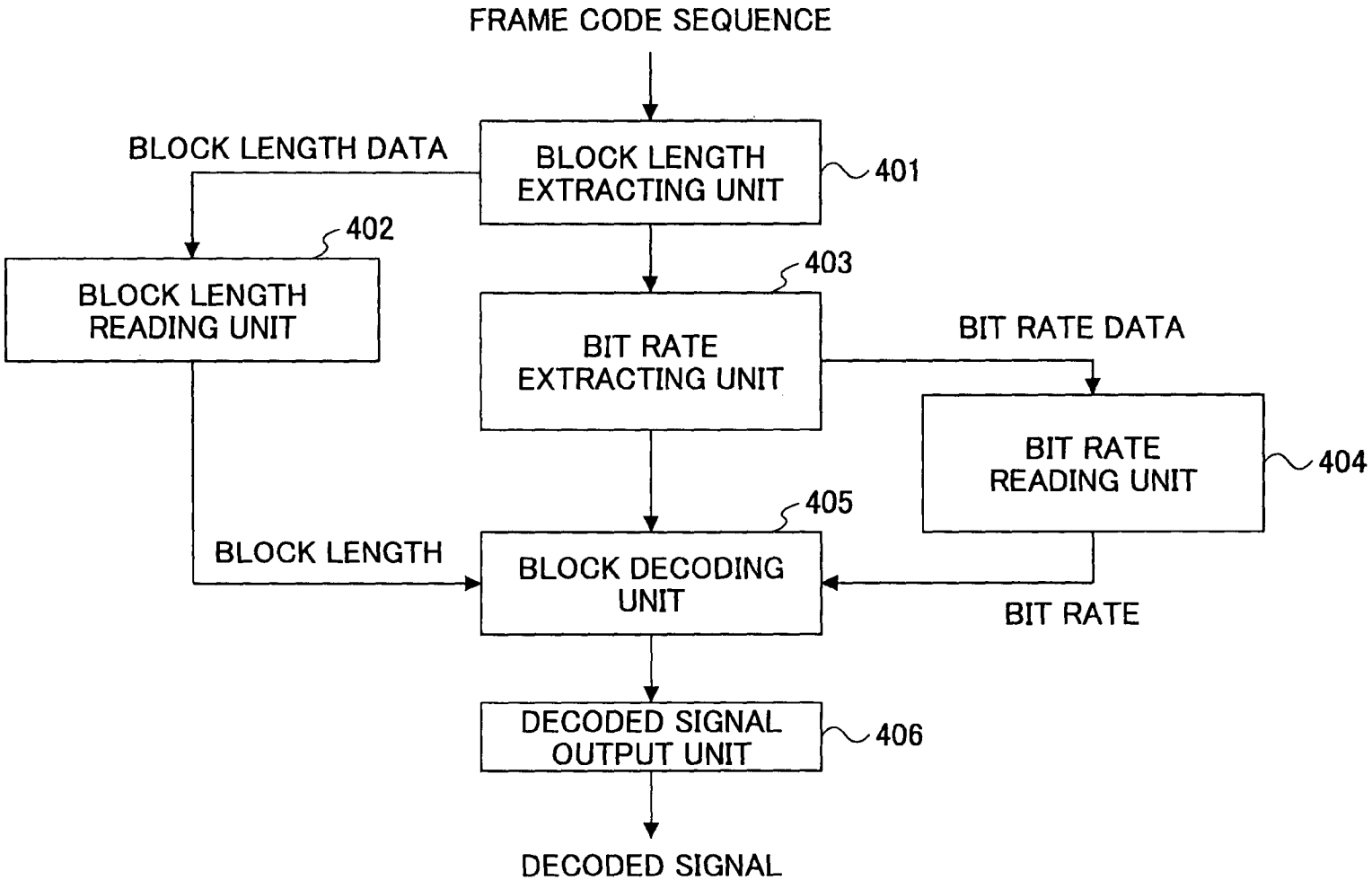
FIG. 14 is a block diagram showing an example of a configuration of a decoding device according to a fourth embodiment of the present invention.

FIG. 14 is a block diagram showing an example of a configuration of a decoding device 400 according to a fourth embodiment of the present invention.

The decoding device 400 includes a block length extracting unit 401, a block length reading unit 402, a bit rate extracting unit 403, a bit rate reading unit 404, a block decoding unit 405, and a decoded signal output unit 406.

Below, it is assumed that the code sequence input to the decoding device 400 is generated by a coding device performing coding in the following way, that is, the original data input to the coding device are divided into temporally continuous frames each having a length N, and the average bit rate over one frame is not higher than a specified value, for example, 20 kbps, and the blocks used in the above coding are the same as those shown in FIGS. 3A through 3C, that is, the L block, M block, and S block, and the bit rate in coding a block may be any of 16 kbps, 20 kbps, and 24 kbps.

For example, the frame code sequence as shown in FIG. 5 is output from the coding device and is input to the decoding device 400. The block length extracting unit 401 extracts the block length information appended to the frame code sequence input to the decoding device 400. Specifically, because the frame code sequence as shown in FIG. 5 is input to the decoding device 400, the block length extracting unit 401 extracts the block length information allocated at the beginning of the frame code sequence, and outputs the resultant block length information to the block length reading unit 402.

Based on the block length information, the block length reading unit 402 reads the lengths of all blocks corresponding to the block code sequences included in the frame code sequence input to the decoding device 400. Further, the block length reading unit 402 sends the block length data to the block decoding unit 405.

The bit rate extracting unit 403 extracts the coding bit rate information appended to the frame code sequence input to the decoding device 400. Specifically, because the frame code sequence as shown in FIG. 5 is input to the decoding device 400, the bit rate extracting unit 403 extracts the coding bit rate information allocated at the beginning of the frame code sequence. Further, the bit rate extracting unit 403 outputs the extracted bit rate information to the bit rate reading unit 404.

Based on the bit rate information, the bit rate reading unit 404 reads the bit rates in coding all the blocks corresponding to all the block code sequences included in the frame code sequence input to the decoding device 400. Further, the bit rate reading unit 404 sends the coding bit rate data to the block decoding unit 405.

In addition, the block length extracting unit 401 deletes the block length data from the frame code sequence input to the decoding device 400, and the bit rate extracting unit 403 deletes the coding bit rate data from the frame code sequence input to the decoding device 400. Therefore, only block code sequences included in the frame code sequence are input to the block decoding unit 405.

The block decoding unit 405 sets parameters for decoding the block code sequences based on the block length data sent from the block length reading unit 402 and the coding bit rate data sent from the bit rate reading unit 404, and then decodes the block code sequences.

It is assumed that the block decoding unit 405 determines that in the sequence of FIG. 5, block k1 (S block) is coded at a bit rate of 16 kbps, block k2 (S block) is coded at bit rates of 20 kbps, and block k3 (M block) is coded at a bit rate of 20 kbps; and the block decoding unit 405 sets the decoding parameters and performs decoding corresponding to the coding process based on the determination. In this way, decoded signals corresponding to frames of length N can be obtained.

The block decoding unit 405 outputs the decoded signals to the decoded signal output unit 406. It should be noted that the block decoding unit 405 does not need to output the decoded signals in units of frames; it may decode the block code sequences and output the decoded signals in units of blocks.

The decoded signal output unit 406 outputs the decoded signals.

In the above, descriptions are made of a case in which the frame code sequence as shown in FIG. 5 is output from a coding device and is input to the decoding device 400. The decoding device 400 is also capable of receiving the frame code sequence shown in FIG. 6. In this case, because the block length information and the bit rate information are allocated in the block code sequences in the frame code sequence, the decoding device 400 extracts the block length information and the bit rate information and performs decoding block by block. By doing so, even if some data are lost, not all of the block length information and the bit rate information will be lost, and this prevents the situation of being unable to decode.

Figure 15:
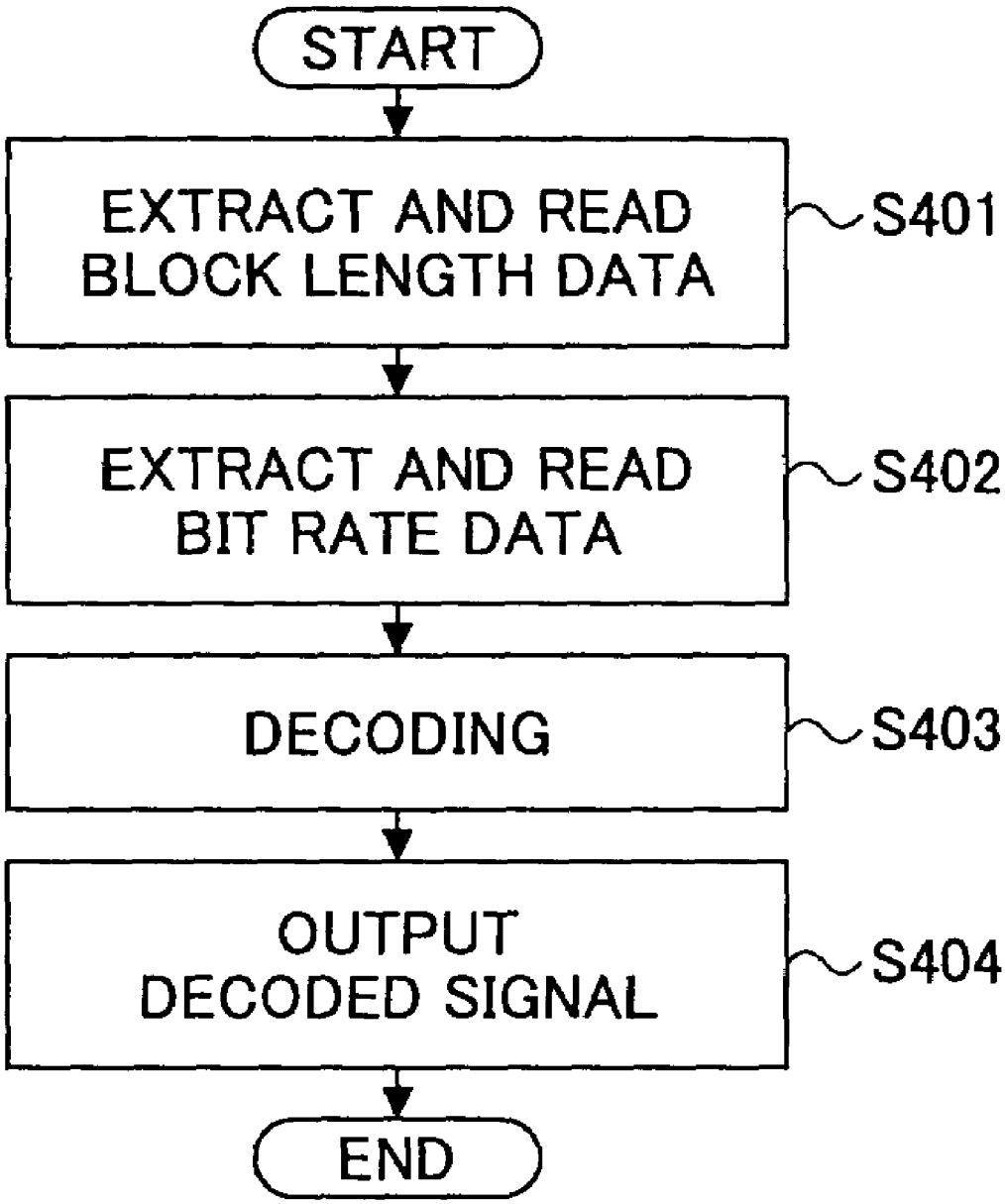
FIG. 15 is a flow chart showing the operations of the decoding device according to the fourth embodiment.

FIG. 15 is a flow chart showing the operations of the decoding device 400 according to the fourth embodiment.

As shown in FIG. 15, in step S401, the decoding device 400 extracts the block length information appended to the frame code sequence output from a coding device and reads the lengths of all blocks corresponding to all the block code sequences included in the frame code sequence.

In step S402, the decoding device 400 extracts the coding bit rate information appended to the frame code sequence output from a coding device and reads the bit rates in coding all blocks corresponding to all the block code sequences included in the frame code sequence.

In step S403, based on the block length data and the coding bit rate data, the decoding device 400 decodes the block code sequences included in the frame code sequence.

In step S404, the decoding device 400 outputs the decoded signals.

In this way, according to the above embodiments, the coding device makes both the length of a block and the bit rate in coding the block variable. Therefore, it is possible to perform coding and output a code sequence so as to ensure optimum quality and an average bit rate not higher than a specified value in coding a frame. As a result, the coding device is capable of improving the coding efficiency and the coding quality.

Further, because the coding device appends the block length information and the coding bit rate information to the output frame code sequence, a decoding device that receives the frame code sequences may perform decoding appropriate to the coding process based on the block length information and the coding bit rate information.

While the present invention has been described with reference to specific embodiments chosen for purpose of illustration, it should be apparent that the invention is not limited to these embodiments, but numerous modifications could be made thereto by those skilled in the art without departing from the basic concept and scope of the invention.

For example, in the above embodiments, it is described that the coding device selects a code sequence that makes the power of the difference between a local decoded signal and an input signal the minimum, but other methods for making the evaluation and selecting a code sequence may also be used, for example, the coding device may select a code sequence that makes the SNR (Signal-to-noise-ratio) a maximum.

Summarizing the effect of the invention, according to the present invention, the coding device makes both the lengths of blocks and the bit rates in coding the blocks variable. Therefore, it is possible to perform coding according to the combination of the block lengths and the bit rates. Further, among the resultant code sequences, a data sequence can be selected and output that optimizes the coding quality in coding a whole frame, and ensures a bit rate not higher than a specified value in coding the whole frame. As a result, it is possible to improve the coding efficiency and the coding quality.

This patent application is based on Japanese Priority Patent Application No. 2002-244021 filed on Aug. 23, 2002, the entire contents of which are hereby incorporated by reference.

What is claimed is:

1. A coding device for coding an input signal, said coding device dividing the input signal into temporally continuous frames each including a predetermined number of discrete temporal samples, the coding device comprising:

a dividing unit configured to divide each of the frames into one or more blocks, said dividing unit dividing each of the frames using a plurality of block combinations;

a coding unit configured to code each of the blocks at a plurality of bit rates and generate a plurality of block code sequences; and a determination unit configured to select a frame code sequence corresponding to one of the block combinations so that the selected frame code sequence has optimum quality and that an average bit rate for coding the corresponding block combination is not higher than a predetermined bit rate, said determination unit selecting the frame code sequence by determining the block lengths of the respective blocks in the corresponding block combination and determining the bit rates for coding the respective blocks in the corresponding block combination.

2. The coding device as claimed in claim 1, further comprising:

a coding quality evaluation unit configured to determine data of quality of each of frame code sequences corresponding to the respective block combinations; and an output unit configured to output the selected frame code sequence.

3. The coding device as claimed in claim 2, wherein the coding quality evaluation unit calculates a sum of data of quality of the block code sequence corresponding to one of the blocks to be coded and the data of quality of the block code sequences corresponding to blocks prior to the one of the blocks to be coded; and the determination unit uses the sum of the data of quality in determination of the block lengths and the bit rates.

4. The coding device as claimed in claim 2, wherein the determination unit determines the block lengths and the bit rates using the Viterbi algorithm.

5. The coding device as claimed in claim 2, wherein the data of quality includes an electric power of a difference between a signal obtained by decoding one of the frame code sequences and a corresponding portion in the input signal; and the determined block lengths and the bit rates make the electric power of the difference substantially a minimum.

6. The coding device as claimed in claim 2, wherein the data of quality includes a signal-to-noise-ratio of a signal obtained by decoding one of the frame code sequences; and the determined block lengths and the bit rates make the signal-to-noise-ratio substantially a maximum.

7. The coding device as claimed in claim 2, wherein a weighting factor determined by human perceiving characteristics is applied to the data of quality.

8. The coding device as claimed in claim 2, wherein the output unit appends data of the block lengths and the bit rates to the selected frame code sequence.

9. The coding device as claimed in claim 8, wherein the output unit appends the data of the block lengths and the bit rates to the corresponding block code sequences in the selected frame code sequence, respectively.

10. A decoding device for decoding an input code sequence obtained by coding an input signal, said input signal being divided into temporally continuous frames each including a predetermined number of discrete temporal samples, and each of the frames being divided into one or more blocks for coding, the decoding device comprising:

an information extracting unit configured to extract data of block lengths of the respective blocks, and data of bit rates for coding the respective blocks from the input code sequence; and a decoding unit configured to decode the input code sequence according to the extracted data of the block lengths and the data of the bit rates.

11. The decoding device as claimed in claim 10, wherein the data of the block lengths and the data of the bit rates are appended to the input code sequence.

12. The decoding device as claimed in claim 11, wherein the input code sequence includes one or more block code sequences obtained by coding the respective blocks; and the data of the block lengths and the data of the bit rates are appended to the block code sequences, respectively.

13. A coding method for coding an input signal, wherein the input signal is divided into temporally continuous frames each including a predetermined number of discrete temporal samples, the coding method comprising:

a first step of dividing each of the frames into one or more blocks, said each of the frames being divided by using a plurality of block combinations;

a second step of coding each of the blocks at a plurality of bit rates and generating a plurality of block code sequences; and a third step of selecting a frame code sequence corresponding to one of the block combinations so that the selected frame code sequence has optimum quality and that an average bit rate for coding the corresponding block combination is not higher than a predetermined bit rate, said selected frame code sequence being selected by determining the block lengths of the respective blocks in the corresponding block combination and the bit rates for coding the respective blocks in the corresponding block combination.

14. The coding method as claimed in claim 13, further comprising:

a step, before the third step, of determining data of quality of each of frame code sequences corresponding to the respective block combinations; and a step, after the third step, of outputting the selected frame code sequence.

15. A decoding method for decoding an input code sequence obtained by coding an input signal, said input signal being divided into temporally continuous frames each including a predetermined number of discrete temporal samples, and each of the frames being divided into one or more blocks for coding, the decoding method comprising the steps of:

extracting data of block lengths of the respective blocks and data of bit rates for coding the respective blocks; and decoding the input code sequence according to the extracted data of the block lengths and the data of the bit rates.

* * * * *